US007367858B2

(12) United States Patent
Matuska et al.

(10) Patent No.: US 7,367,858 B2
(45) Date of Patent: May 6, 2008

(54) PADDLE SHAFT COUPLER

(75) Inventors: Joseph Wiliam Matuska, Port Coquitlam (CA); Andrew Yang Tong, Richmond (CA)

(73) Assignee: Aqua-Bound Technology Ltd., Surrey, British Columbia (CA)

( * ) Notice: Subject to any disclaimer, the term of this patent is extended or adjusted under 35 U.S.C. 154(b) by 50 days.

(21) Appl. No.: 11/407,589

(22) Filed: Apr. 20, 2006

(65) Prior Publication Data

US 2006/0252317 A1 Nov. 9, 2006

Related U.S. Application Data

(60) Provisional application No. 60/673,055, filed on Apr. 20, 2005.

(51) Int. Cl.
*B63H 16/04* (2006.01)
*B63H 16/10* (2006.01)

(52) U.S. Cl. ..... 440/101; 440/102

(58) Field of Classification Search ..... 440/101, 440/102; 416/74; 403/335, 359, 97, 101, 403/371, 381, 348, 298, 46, 84, 109.1, 109.2, 403/109.4, 109.5, 349, 350, 353
See application file for complete search history.

(56) References Cited

U.S. PATENT DOCUMENTS

| | | | | |
|---|---|---|---|---|
| 3,970,032 | A * | 7/1976 | Phillips | 440/102 |
| 4,605,378 | A | 8/1986 | Hamilton | |
| 4,820,216 | A | 4/1989 | Masters | |
| 6,022,255 | A * | 2/2000 | Lukanovich | 440/101 |
| 6,881,111 | B2 | 4/2005 | Bridge et al. | |

* cited by examiner

*Primary Examiner*—Lars A Olson
*Assistant Examiner*—Daniel V Venne
(74) *Attorney, Agent, or Firm*—Morrison & Foerster LLP

(57) ABSTRACT

A coupling apparatus for adjusting and axially coupling first and second shafts about a feathering axis, comprising a collar having an end face having a plurality of axial notches, an insert having an extended portion and at least one radial pin and a cam ring circumscribing the collar. The collar is securable to a free end of a first. The insert is securable in a free end of a second shaft such that the extended portion extends axially from the second shaft and are receivable in the free end of the first shaft such that the pins engage upon the notches so as to axially couple the first and second shafts. The cam ring includes a plurality of radial flange segments and is rotatable to engage the pins so as to retain the pins in engagement with the notches.

26 Claims, 6 Drawing Sheets

PADDLE SHAFT COUPLER

CROSS-REFERENCE TO RELATED APPLICATIONS

This application claims the benefit of U.S. provisional application Ser. No. 60/673,055, filed Apr. 20, 2005, the content of which is incorporated herein by reference.

BACKGROUND OF THE INVENTION

1. Field of Invention

This invention relates to a shaft coupling apparatus, and more particularly, to an apparatus for providing a repositionable paddle assembly for varying the relative pitch angle between oppositely disposed paddle blades.

2. Description of Related Art

The sport or activity of kayaking is rapidly growing in popularity as it provides a source of enjoyment/entertainment, rigorous exercise, and a unique connection with nature. One can analogize kayaking to the sport of cycling inasmuch as each involves individual effort, self-motivation, and self-propulsion.

While kayaking has many similarities to cycling, there is a large disparity in the number of individuals who enjoy each activity. Aside from the obvious need for a body of water, the cost and convenience of kayaking is, perhaps, the largest deterrent to involvement in the sport. Fortunately, recent innovations in kayak and kayak paddle design and manufacture have made kayaking more affordable, easier to handle/maneuver, and less cumbersome to transport.

Consequently, there is a constant evolution in kayak paddle design aimed at making kayaking more enjoyable. For example, Aqua-Bound Technology Ltd., one of the largest manufacturer's of kayak paddles and accessories, were one of the first to introduce gas assist injection molded kayak paddles which made paddles, previously one of the most expensive accessories required, much more affordable.

Other advances in the area of kayak design and construction, to which the present invention is directed, relates to reconfiguring twin-bladed paddle assemblies to vary the pitch angle between opposing blades. Paddle blade assemblies are often constructed with a pair of paddle blades mounted at opposite ends of a central handle. While such paddle assemblies facilitate an ergonomically smooth motion i.e., as a paddler passes each paddle blade through the water to either side of a kayak, the paddle blade which rises above the water can produce significant aerodynamic drag especially in windy conditions. That is, when a paddler passes one paddle blade through the water, the opposing blade can, if disposed at a high angle of attack relative to the freestream airflow, produce significant profile drag. Such drag forces are, it will be appreciated, exacerbated by high wind speeds/gusts commonly produced on the water. To counteract such drag forces, it is typical for paddle assemblies to include a center coupling capable of varying the relative pitch angle of the paddle blades. That is, by disposing the blades at a relative pitch angle of, for example, 60 to 90 degrees, the paddle blade in the free stream airflow can be feathered to an angle close to a zero angle of attack. Furthermore, depending upon the direction of the wind relative to the watercraft, other pitch angles may be desired to minimize drag.

U.S. Pat. No. 4,605,378 to Hamilton discloses a repositionable coupling which employs a spring biased pin disposed in telescoping segments of a paddle assembly. The pin, which is connected to one of the paddle segments, seats within an aperture of the other segment. By depressing the spring biased pin, the paddle assemblies may be rotated until the pin is reset into a second aperture, e.g., disposed 90 degrees apart from the first, to change the relative pitch angle of the paddle blades. While this paddle design addresses the difficulties associated with aerodynamic drag, the repositionable coupling has certain design deficiencies. For example, only a limited number of apertures can be employed without impacting the structural integrity of the paddle assembly. Hence, the relative rotational position of the paddle assemblies is limited to several choices, e.g., +/−90 degrees.

Furthermore, after extended use, the coupling can fail or develop "play" due to fretting wear between the pin and aperture. That is, the aperture can become elongated or oval-shaped over time such that the coupled components become loose and prematurely fail.

Yet other prior art coupling arrangements such as that illustrated in U.S. Pat. No. 6,881,111 to Bridge, et al. employ a combination of spring biased pins and a spline for accepting an elongate key. While this coupling design eliminates the structural deficiencies of the Hamilton '378 patent, i.e., by separating the axial and torsional load paths, this arrangement employs a number of moving parts and/or high tolerance connections. As such salt water corrosion of the spring mechanism as well as debris from sand or salt deposits can jam or otherwise render the coupling inoperable.

A need, therefore, exists for a reliable and secure repositionable coupling which enables greater flexibility in terms of paddle blade positioning.

SUMMARY OF THE INVENTION

In accordance with one aspect of the present invention there is provided a coupling apparatus for adjustably and axially coupling first and second shafts about a feathering axis. The coupling apparatus comprises a collar having an end face. The end face has a plurality of axial notches and is securable to a free end of the first shaft. The coupling apparatus further includes an insert having an extended portion and at least one radial pin. The insert is securable in a free end of the second shaft such that the extended portion extends axially from the second shaft, whereby, the extended portion is receivable in the free end of the first shaft such that the pins engage upon the notches so as to axially couple the first and second shafts. The coupling apparatus further includes a cam ring circumscribing the collar. The cam ring has a plurality of radial flange segments having a cam surface facing said engagement plane. The cam ring is rotatable to engage the pins so as to retain the pins in engagement with the notches for fixing the relative position of the first and second shafts.

In accordance with another aspect of the present invention, there is provided a twin-bladed paddle assembly comprising first and second paddle segments each having a handle portion for mounting a paddle blade at an outboard end. The handle portions define a feathering axis about which the paddle segments may independently rotate. The first handle portion has at least one radial pin. The second handle portion has at least one axial notch which accept and engage the radial pins along an engagement plane. The twin-bladed paddle assembly further includes a camming device adapted to retain the pins in engagement with the notches to rotationally fix the relative angular position of the paddle segments.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

The following discussion is presented to enable one skilled in the art to make and use the invention. Various modifications to the disclosed embodiments will be readily apparent to those skilled in the applicable art, and the teachings herein may be applied to other embodiments without departing from the spirit and scope of the invention as defined in the appended claims. Thus the present invention is not intended to be limited to the embodiments shown, but is to be afforded the broadest scope consistent with the principles and features disclosed herein.

The invention described herein relates to a two bladed paddle to propel a watercraft along each side thereof. Furthermore, the two-bladed paddle is configured for use by a single paddler to maximize handling efficiency, i.e., use a smooth uninterrupted motion to manipulate the paddle blades through and over the water. Such paddles can generally be used on any boat having a sufficiently narrow beam so as to allow a single paddle to span its width such as a kayak, canoe, pontoon or inflatable boat. Therefore, as will be appreciated from the subsequent description and illustrations, the teachings are broadly applicable to a variety of watercraft applications.

Figure 1:
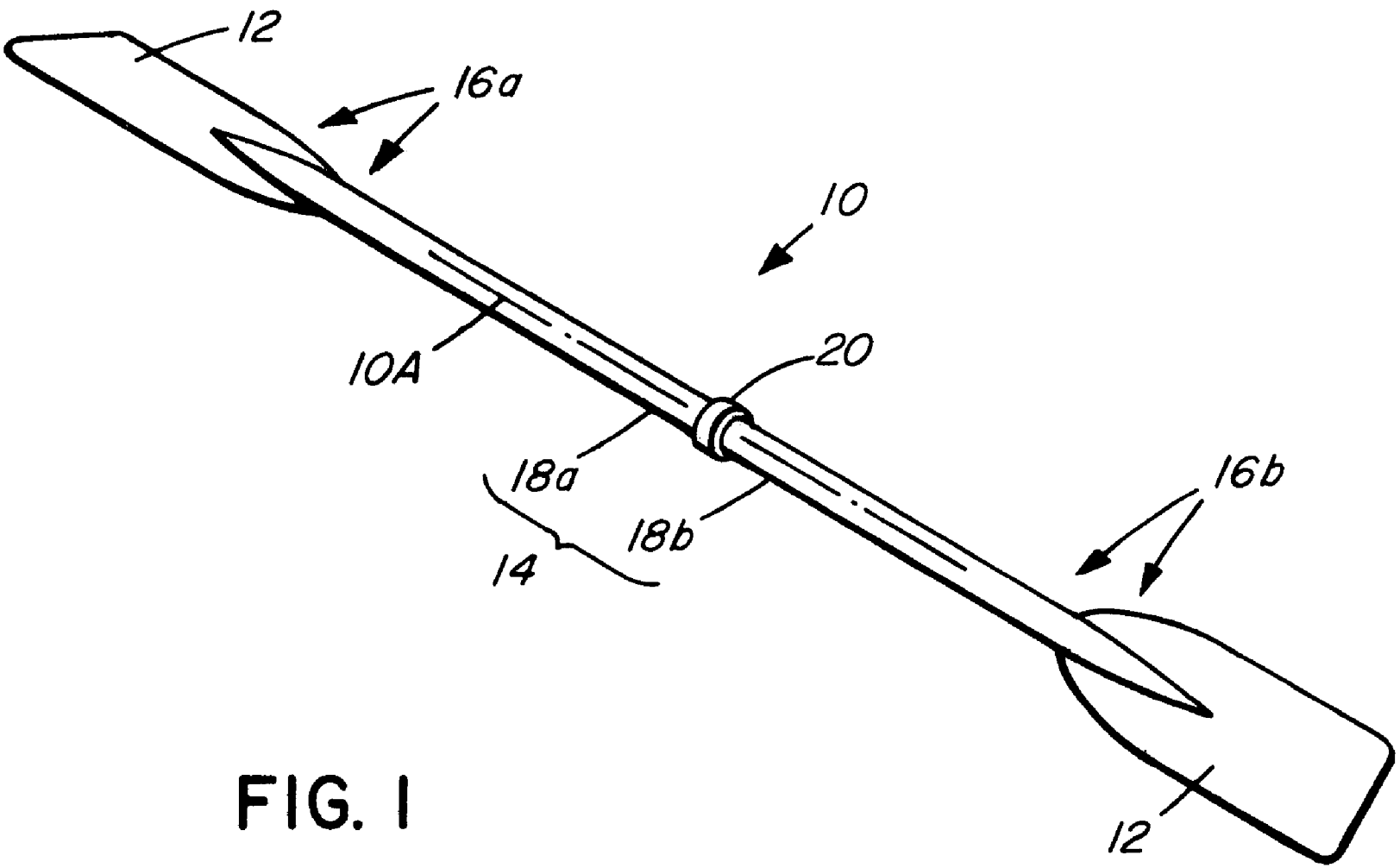
FIG. 1 is a perspective view of a twin-bladed paddle assembly having a repositionable coupling in accordance with an embodiment of the present invention.

In FIG. 1, a perspective view of a kayak paddle assembly 10 is shown including paddle blades 12 disposed on opposite ends of a central handle 14. The central handle 14 is segmented along its length to define first and second paddle segments 16*a*, 16*b*, each of the paddle segments 16*a*, 16*b* including a portion, 18*a* or 18*b*, of the central handle 14 and a single paddle blade 12. Furthermore, each of the paddle segments 16*a*, 16*b* are joined by a repositionable coupling 20 disposed in combination with the handle portions 18*a*, 18*b*, to permit axial separation and relative rotation of the paddle segments 16*a*, 16*b*. That is, the paddle segments 16*a*, 16*b* may be separated to facilitate storage and transport. The paddle segments may also be rotationally repositioned about a feathering axis 10A to facilitate blade angle variations desired during certain boating conditions.

Figure 2:
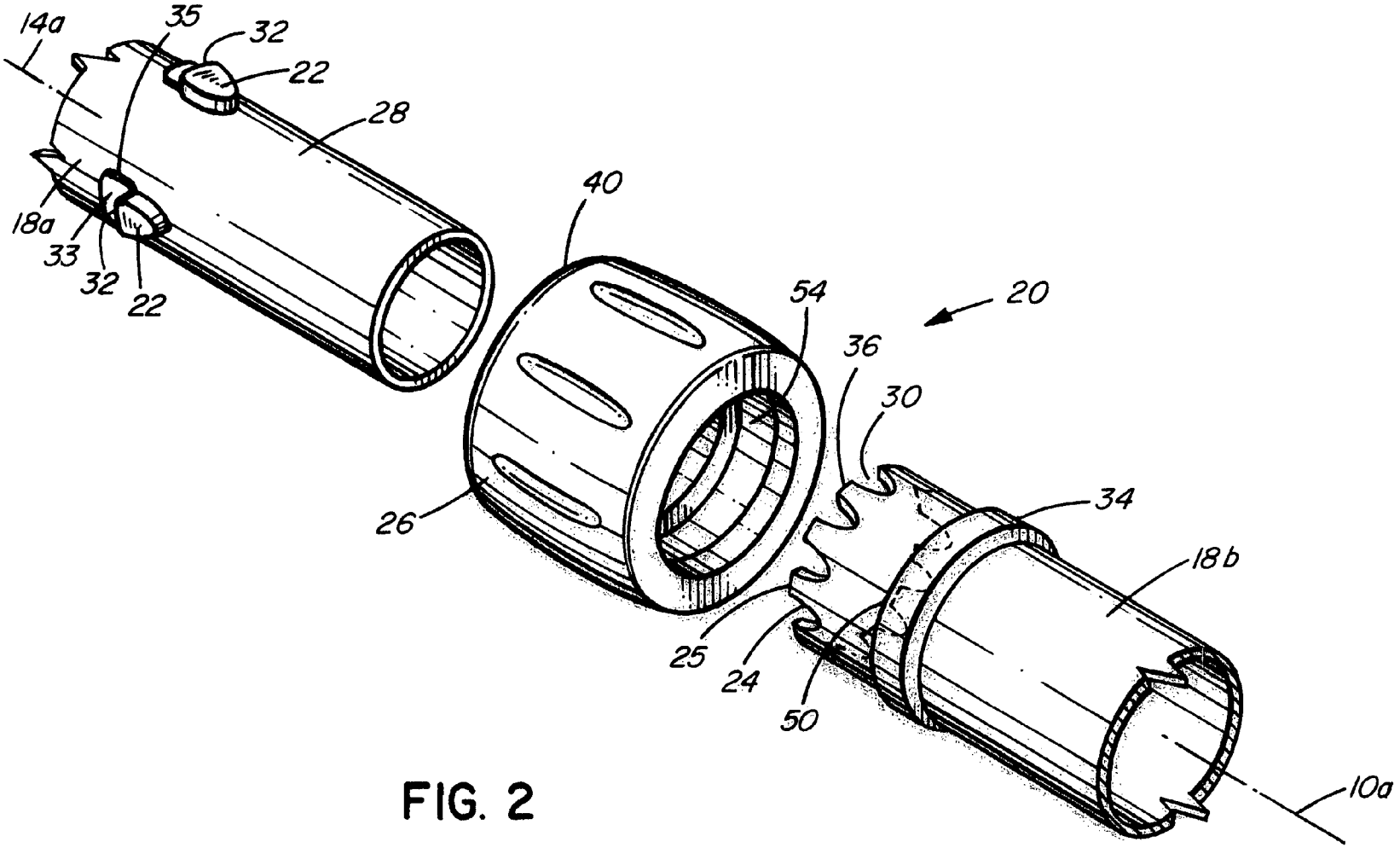
FIG. 2 is an exploded perspective view of the repositionable coupling including a plurality of radial pins, a ring cam, and a plurality of axial notches for accepting and engaging the radial pins.

In FIG. 2, an enlarged isolated perspective view of the repositionable coupling 20 is shown. In the broadest sense of the invention, the coupling 20 includes at least one radial pin 22, a plurality of axial notches 24 and a camming device 26. The radial pins 22 are disposed at an end of one handle portion 18*a*. The axial notches 24 are disposed on an end face 25 of the other handle portion 18*b*, the axial notches accepting and engaging the radial pins 22. The camming device 26 circumscribes and is disposed over an engagement plane defined by the radial pins 22 and axial notches 24. Each of the principle elements of the coupling 20 will be described in greater detail below.

Figure 3:
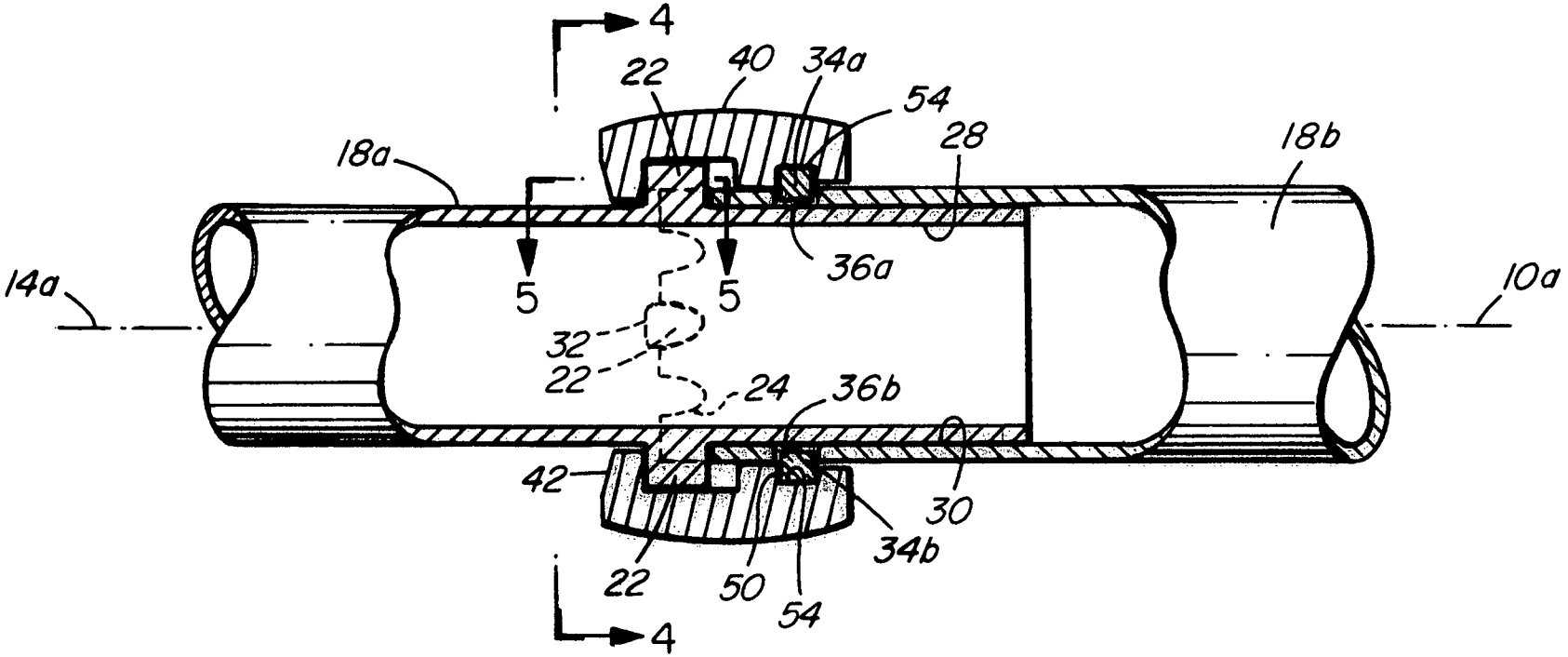
FIG. 3 is a broken away sectional view of the assembled repositionable coupling.

In FIGS. 1, 2 and 3, an innermost end portion 28 of the first handle portion 18*a* is disposed axially inboard of the radial pins 22 to fit snuggly, i.e., telescopes, into a bore 30 defined by the second handle portion 18*b*. Functionally, the telescoping sections 28 serve to align the handle portions 18*a*, 18*b* along the longitudinal axis 14A of the central handle 14 (coincident with the feathering axis 10A) and provide bending moment stability. Furthermore, the telescoping sections 28 permit independent rotational displacement of each paddle segment 16*a*, 16*b* about the feathering axis 10A.

The radial pins 22 preferably extend radially outboard of the face surface of the first handle portion 18*a* and are positioned circumferentially in equiangular increments thereabout. At a minimum, at least one (1) radial pin is used. Preferably, however, four (4) radial pins 22 disposed approximately ninety (90) degrees apart provides even greater load distribution and bending moment stability (i.e., about axes orthogonal to the longitudinal axis 14A). In the preferred embodiment, the radial pins 22 have a substantially V-shaped profile configuration and include at least one substantially planar sidewall surface 32. The significance of this configuration will become clear when describing the operation of the coupling 20 and elements which structurally interact with the sidewall surfaces 32 of the radial pins 22.

The axial notches 24 are formed along the end face 25 of the second handle portion 18*b* in combination or integrally with the face surface of the second handle portion 18*b*. As such, the end face has a shape closely resembling a crown wherein the points 36 thereof project axially from the end of the second handle portion 18*b*. However, it will be appreciated that the axial notches 24 may be formed integrally with the end portion of the handle portion 18*b*. While the number of axial notches 24 can, at minimum, be as few as the number of radial pins 22, preferably, the number of axial notches 24 is a multiple of the number of radial pins 22. In the embodiment shown in FIGS. 1 to 3, sixteen (16) axial notches are employed in varying increments about the end face of the second handle portion 18*b*. Accordingly, the axial notches 24 are disposed at angles between fifteen (15) and thirty (30) degree increments from center to center. While, in the preferred embodiment, the axial notches 24 are arranged in varying increments, it will be appreciated that the notches may be disposed at other angular positions depending upon the desired relative pitch angle between the paddle segments.

The shape of each axial notch 24 preferably compliments the shape of each radial pin 22, and in the described embodiment, defines a substantially V-shaped profile complimenting the preferred shape of the radial pins 22. Furthermore, the depth or axial length of each axial notch is preferably equal to or less than the axial length of the V-shaped notch. One skilled in the art will appreciate that the depth is designed as a function of the anticipated torsional loads, the angle of the V-shaped notch and the maximum shear strength of the materials used to fabricate the radial pins 22 and the axial notches 24.

The camming device 26 envelopes an engagement plane defined by the radial pins 22 and axial notches 24 and may rotate in either direction about the longitudinal axis 14A of the central handle 14. In the context used herein, the "engagement plane" is the plane where each radial pin 22 engages a respective axial notch 24 and is substantially normal to the longitudinal axis 14A of the central handle 14. In the broadest sense, the camming device 26 retains the radial pins 22 in engagement with the axial notches 24. In addition, the camming device 26 may effect axial displacement of the radial pins 22 toward the axial notches 24 to engage/rotationally fix the position of the paddle segments 16*a*, 16*b*. The camming device 26 enables axial displacement of the radial pins 22 away from the axial notches 24, i.e., out of engagement therewith, to permit relative rotation of the paddle segments 16*a*, 16*b*. And, the camming device 26 facilitates axial displacement of the radial pins 22 to detach and/or assemble the paddle segments 16*a*, 16*b*, i.e., for transport or storage of the paddle assembly 10. Consequently, the camming device 26 effects engagement, separation and indexing of the paddle segments 16*a*, 16*b*.

Specifically, and referring to FIGS. 2 through 5, the camming device 26 includes a cam ring 40 defining a plurality of flange segments 42 having first and second ends 45 and 47 respectively, which project radially inwardly toward the longitudinal axis 14A of the central handle 14. Each flange segment 42 includes a stopping portion 46 extending perpendicular from the second end 47 of the flange segments towards the axial notches 24 for engaging upon a side of the radial pins 22 to prevent over-rotation of the cam ring as well as providing extra structural support to the flange segments 42. The flange segments also include a cam surface 44 along a sidewall surface thereof for engaging a sidewall surface 32 of each radial pin 22. The cam surfaces 44 may be inclined relative to the engagement plane and positioned such that the radial pins interpose the flange segments 42 and the axial notches 24. The inclined cam surfaces 44 preferably define a shallow angle θ between about one (1) degree to about ten degrees (10) degrees. More preferably the angle θ of inclination is between about five (5) degrees to ten (10) degrees.

In the described embodiment, the cam ring 40 is mounted about one of the handle portions 18*b* by a low friction bearing assembly or collar 34 for retaining the axial position of the cam ring 40 and facilitating rotational displacement thereof about the longitudinal axis 14A of the central handle 14. The bearing assembly 34 comprises a pair of arcuate shoulders 34*a*, 34*b* disposed along the face surface of the handle portion 18*b*, which shoulders 34*a*, 34*b* engage a cylindrical groove 54 formed internally of the cam ring 40. More specifically, the arcuate shoulders 34*a*, 34*b* protrude through circumferential apertures 36*a*, 36*b* formed through the surface, and proximal to the end, of the handle portion 18*b*. As a consequence, a circumferential abutment surface 50 is generated about the cylindrical face surface of the handle 18 to enable rotation of the cam ring 40 while retaining the axial position of the ring 40.

Figure 5:
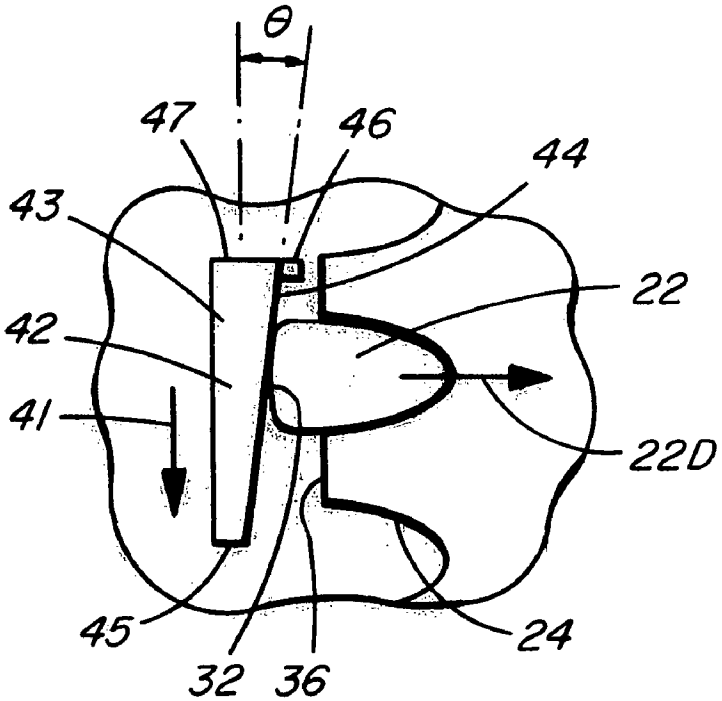
FIG. 5 is a cross sectional view taken substantially along line 5-5 of FIG. 4 showing the operation of a camming device for engaging the radial pins with the axial notches.
Figure 4:
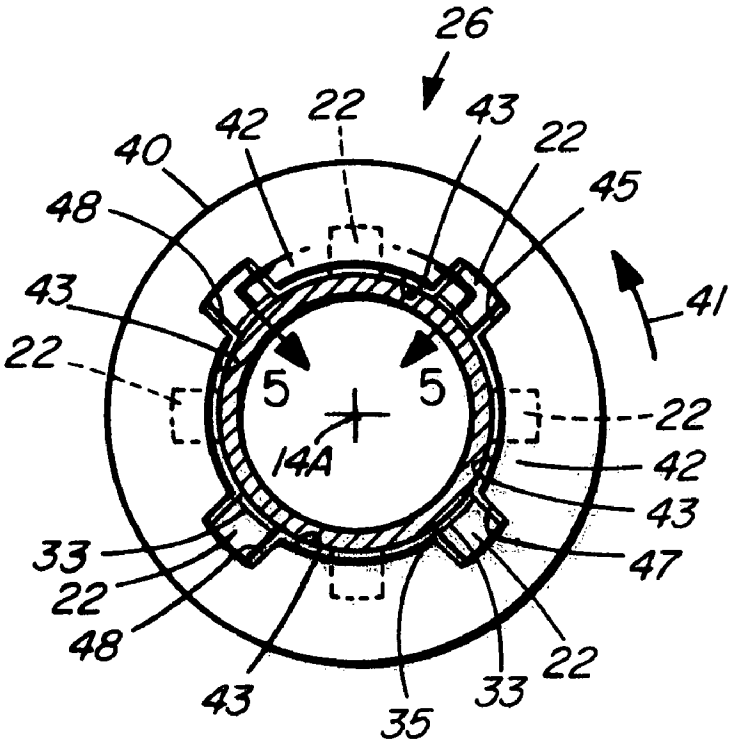
FIG. 4 is a cross sectional view taken substantially along line 4-4 of FIG. 3 showing an end view of the repositionable coupling upon being rotated in a direction which retains the radial pins in engagement with the axial notches.
Figure 7:
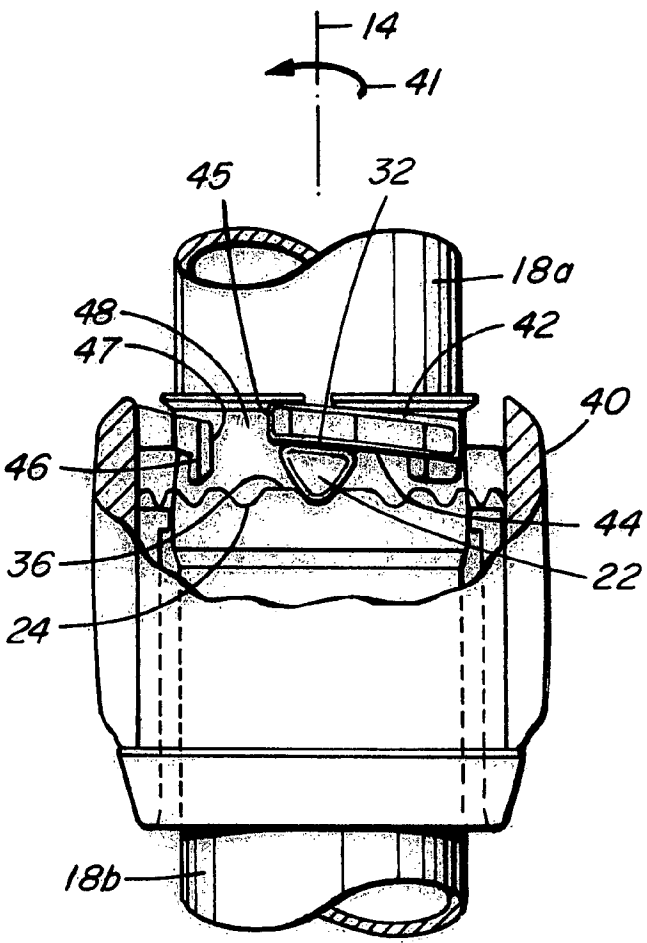
FIG. 7 is a partial longitudinal cross-sectional view of the repositioned coupling of FIG. 1, showing the flange segments retaining the radial pins in engagement with the axial notches.

As such, rotation of the cam ring 40 in one direction i.e., in the direction of arrow 41 as shown in FIGS. 4, 5 and 7, causes the cam surfaces 44 to abut the linear sidewall surfaces 32 of the radial pins 22 and retain the radial pins 22 in engagement with the axial notches 24. Furthermore, should the cam surfaces 44 be inclined as shown, the inclined cam surfaces 44 may urge the radial pins 22 axially in the direction of arrow 22D, into abutting engagement with the axial notches 24. During this rotational motion, the cam ring 40 is retained axially by the abutment surface 50. When the flange segments 42 and cam surfaces 44 have fully engaged the radial pins 22 with the respective set of axial notches 24, frictional forces fix the rotational position of the cam ring 40 relative to the central handle 14. Accordingly, the paddle segments 16*a*, 16*b* are axially and rotationally secured. Rotation of the cam ring 40 in the opposite direction may produce an axial gap between the cam surfaces 44 and the radial pins 22, i.e., sufficient to enable disengagement of the radial pins 22 relative to the axial notches 24.

Figure 6:
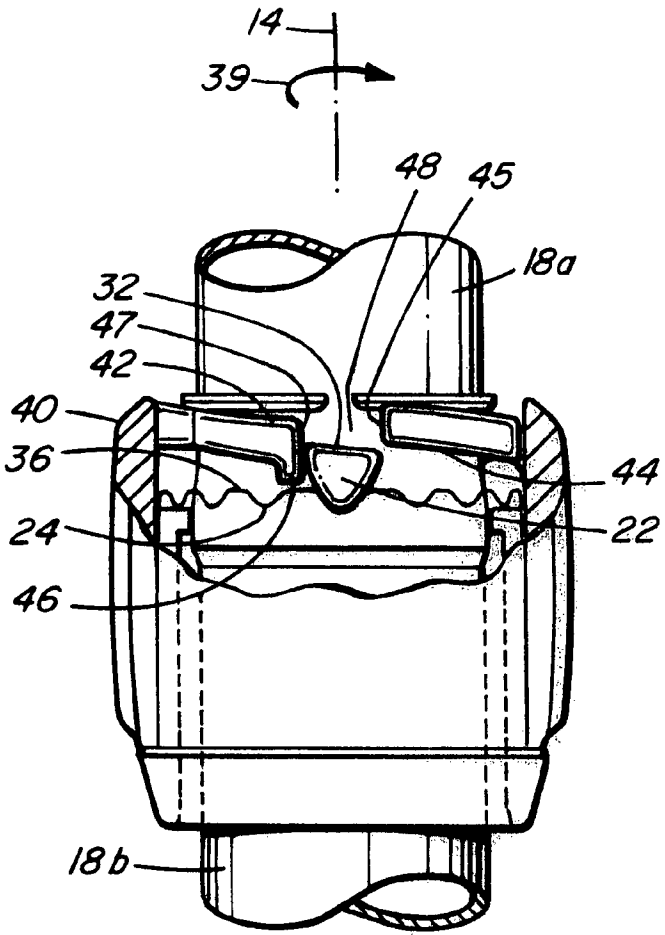
FIG. 6 is a partial longitudinal cross-sectional view of the repositioned coupling of FIG. 1, showing the radial pins aligned with the axial gaps to permit adjustment or separation of the paddle segments.

In the arrangement shown in FIG. 6, the cam ring 40 has been rotated in the direction indicated at 39 such that the radial pins 22 are located within an axial gap 48 between adjacent flange segments 42. This enables the operator/paddler to axially displace the handle portions 18*a* and 18*b* to uncouple or axially realign the first and second paddle segments 16*a* and 16*b*. By aligning the radial pins 22 with the axial gap 48, adequate axial clearance may be provided between the radial pins 22 and axial notches 24, to clear the points 36 between the axial notches 24. Accordingly, the radial pins 22 may be indexed/rotated in either direction for alignment with other axial notches 24 to vary the relative pitch angle of the paddle segments 16*a*, 16*b*, and, consequently, the paddle blades 12. The paddle segments may thereafter be locked together by rotating the cam ring 40 in the direction 41 as shown in FIG. 7.

In addition to enabling axial displacement for indexing purposes, the axial gaps 48 enable detachment of the paddle segments 16*a*, 16*b* for transport and/or storage. That is, to fully separate the paddle segments 16*a*, 16*b*, the radial pins 22 will pass through the axial gaps 48, between the flange segments 42, as the ends of each handle portion 18*a*, 18*b* are telescopically disengaged. It will be appreciated, of course, that the axial gaps 48 also enable attachment and assembly of the paddle segments 16*a*, 16*b*, as the radial pins 22 are passed therethrough to engage the axial notches 24.

As shown in FIG. 2, the first paddle portion 18*a* may further includes a friction pad 33 disposed adjacent to the radial pins 22. The friction pad 33 comprises a raised surface adapted to frictionally engage a corresponding engagement surface 43 on the flange segments 42. As shown in FIG. 2, the friction pad are located adjacent to the radial pins 22 in the longitudinal direction of the paddle blade 12 of the first paddle portion. The friction pads 33 include a leading edge 35 which is longitudinally offset relative to a corresponding leading edge of the radial pin. When the cam ring 40 is rotated in the direction indicated by 41 in FIG. 7, the engagement surface 43 of the flange segments 42 will contact the leading edge 35 of the friction pads 33 before the cam surface 44 if longitudinally aligned with the corresponding leading edge of the radial pin. Further rotation of the cam ring 40 relative to the first handle portion 18*a* will cause the engagement surfaces 43 to frictionally traverse the friction pads 33.

According to the present embodiment, the friction pads 33 serve two purposes. When the coupling 20 is in the arrangement as shown in FIG. 6, the contact between the leading edge 35 of the friction pads 33 and the engagement surface will cause the first handle portion 18*a* to rotate with the cam ring 40 if the first handle portion 18*a* is not rotational secured relative to the cam ring 40. This will enable the user to rotate the first handle portion 18*a* to a desired position relative to the second handle portion 18*b* by turning the cam ring 40 while holding the second handle portion 18*b*. The user may then rotate the cam ring 40 relative to the first handle portion 18*a* to lock the coupling 20.

The second purpose of the friction pads 33 is to provide a more secure locking engagement between the first and second handle portions 18*a* and 18*b* when the coupling 20 is in the arrangement as shown in FIG. 7. Due to the angle of inclination of the flange segments 42 in some embodiments, should the cam ring 40 become loosened from it's locked position due to impacts, vibration or improper locking, the cam ring may then freely rotate out of the locked position shown in FIG. 7 to the open position shown in FIG. 6. The friction pads 33 prevent this free rotation by providing an addition friction contact between the cam ring 40 and the first handle portion 18*a* that opposes free rotation of the cam ring relative to the first handle portion 18*a*.

In summary, the twin bladed paddle assembly and coupling kit provide a repositionable coupling to vary the relative pitch angle of opposing paddle blades. The repositionable coupling employ a ring cam to frictionally engage and secure the radial pins against the axial notches. Furthermore, the repositionable coupling enables greater flexibility in terms of the number of angular positions available for indexing the paddle segments. It will be recalled that the number apertures employed in prior art paddle assemblies was limited due to structural considerations.

In addition, the apertures of prior solutions interposed the axial, torsional and bending moment load paths in the central handle of the prior art paddle assemblies. In contrast, axial and bending moment loads bridge the repositionable coupling without passing through the axial notches, thereby reducing the loads required to be supported by the notches and pins. Moreover, the repositionable coupling employs a minimum number of easily accessible moving parts for improving its overall reliability. That is, the opportunity for sand or salt to jam the coupling is minimized, as the moving parts and connections of the repositionable coupling may be readily accessed for cleaning when the paddle portions are separated. Finally, the paddle assembly and coupling of the present invention is elegantly simple and, as a consequence, fabrication costs are minimized.

Figure 8:
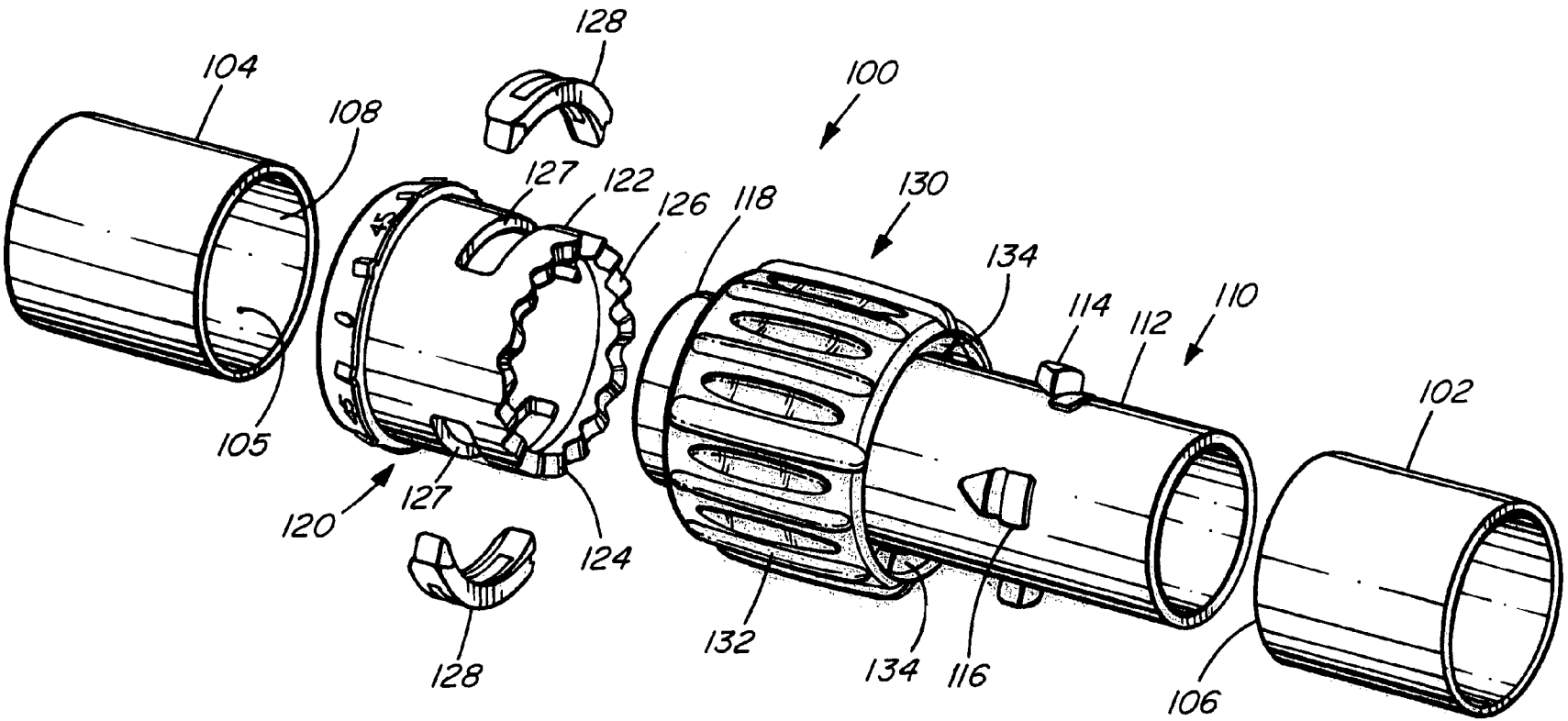
FIG. 8 is an exploded perspective view of a coupler according to another embodiment of the present invention.

A further embodiment of the present invention is shown in FIG. 8. In the embodiment shown in FIG. 8, the coupling 100 comprises a kit that may be applied to a new pair of paddle portions 102 and 104 or retrofitted to existing paddle portions. The coupling 100 comprises an insert 110, a collar 120 and a cam ring 130. As shown in FIG. 8, the insert 110 comprises a cylindrical body 112 operable to be inserted into a free end 106 of a first paddle portion 102 and secured thereto. The insert 110 includes radial pins 114 and friction pads 116 as previously described. The insert 110 also includes an extended portion 118 which extends coaxial with and away from the first paddle portion 102 when the insert is inserted in the first paddle portion. The radial pins 114 may be spaced longitudinally a distance from the free end 106 of the first paddle portion when the insert is secured to the first paddle portion.

The collar 120 comprises a tubular body 122 having a first end 124. The first end 124 includes a plurality of axial notches 126 disposed radially around the first end as previously described. The collar may be applied to a free end 108 of the second paddle portion 104 such that the axial notches are longitudinally spaced a distance from the free end 108. The collar includes shoulder inserts 128 adapted to be received within apertures 127 in the collar so as to form a circumferential ridge around the collar.

The cam ring 130 coaxially and rotatably circumscribes the axial notches 126. The cam ring comprises a tubular body 132 and includes a plurality of flange segments 134 longitudinally spaced apart from the axial notches and as previously described. The cam ring 130 includes a circumferential slot adapted to be received upon the ridge formed by shoulder inserts 128 of collar 120.

As set out above, the insert may be inserted into the free end of a first paddle portion while the collar surrounds the free end of a second paddle portion. The two paddle portions may then be connected by inserting the extended portion into a corresponding bore 105 in the free end 104 of the second pipe portion. The first and second paddle portions may then be pressed together until the radial pins 114 engage with the axial notches 126. The first and second paddle portions may then be locked together by rotating the cam ring so as to cause said flange segments to retain the radial pins in the axial notches.

While the invention has been described in terms of an exemplary embodiment, it will be appreciated that other changes, variations and omissions may be made within the spirit and scope of the invention. For example, while a V-Shaped radial pin and axial notch are shown in the described embodiment, the pins may be cylindrical or define another polygonal profile configuration. While the number of axial notches illustrated is sixteen, the number is at least equal to or a multiple of the number of radial pins.

While the cam ring 40 is shown to define axial gaps 48 between the flange segments 42, the cam ring 40 need only provide a recess or clearance for the radial pins 22 to disengage the axial notches 24. As discussed supra, the axial gaps 48 facilitate separation of the paddle segments, however, such separation may be effected in a variety of other ways.

While specific embodiments of the invention have been described and illustrated, such embodiments should be considered illustrative of the invention only and not as limiting the invention as construed in accordance with the accompanying claims.

What is claimed is:

1. A coupling apparatus for adjustably and axially coupling first and second shafts about a feathering axis, the coupling apparatus comprising:

a collar having an end face, the end face having a plurality of axial notches, the collar being securable to a free end of the first shaft;

an insert having an extended portion and at least one radial pin, the insert being securable in a free end of the second shaft such that the extended portion extends axially from the second shaft, whereby, the extended portion is receivable in the free end of the first shaft such that said at least one radial pin engages upon one of said plurality of axial notches along an engagement plane so as to axially couple the first and second shafts; and a cam ring circumscribing said collar, the cam ring having a plurality of radial flanges, each of said flanges having a camming surface facing said engagement plane, said flanges projecting inwardly toward said feathering axis, each flange having first and second ends and defining radial slots between said first end and a second end of an adjacent flange for permitting said at least one radial pin to pass for detachment and repositioning of the first and second shafts, said cam ring being rotatable to engage said camming surface with said at least one radial pin so as to retain said at least one radial pin in engagement with said notches for fixing the relative position of the first and second shafts.

2. The coupling apparatus of claim 1 wherein said first and second shafts comprise first and second paddle segments each having paddle blades at a distal end thereof.

3. The coupling apparatus of claim 1 wherein said at least one radial pin comprises 4 radial pins.

4. The coupling apparatus of claim 1 wherein said plurality of axial notches comprises a multiple of the number of said at least one radial pin.

5. The coupling apparatus of claim 1 wherein said at least one radial pin and said plurality of axial notches have complementary shapes.

6. The coupling apparatus of claim 5 wherein said at least one radial pin and said plurality of axial notches have substantially V-shapes.

7. The coupling apparatus of claim 1 wherein said engagement plane is normal to said feathering axis.

8. The coupling apparatus of claim 1 wherein said at least one radial pin has at least one substantially radial sidewall surface for engaging said camming device.

9. The coupling apparatus of claim 1 wherein said flanges further include a stopping portion extending substantially perpendicular from said second end of said flange towards said axial notches.

10. The twin-bladed paddle assembly of claim 9 wherein said cam ring is longitudinally fixed to and freely rotatable relative to one of said handle portions.

11. The twin-bladed paddle assembly of claim 10 further including raised portions adjacent to said at least one radial pin, wherein said flanges include radially inwardly facing friction surfaces adapted to frictionally engage upon said raised portions.

12. The twin-bladed paddle assembly of claim 11 wherein said raised portions are located longitudinally on said handle portion toward said paddle blade.

13. The twin-bladed paddle assembly of claim 12 wherein said raised portions and said at least one radial pin have leading edges being the edges that are first engaged by said friction surfaces and said flanges respectively as said cam ring is rotated into said first position, said leading edge of said friction surface being axially staggered relative to said leading edge of said at least one radial pin such that said leading edge of said friction surface is engaged before said leading edge of said at least one radial pin when said cam ring is rotated into said first position.

14. The coupling apparatus of claim 2 wherein said flanges further include a stopping portion extending substantially perpendicular from said second end of said flange towards said axial notches.

15. The coupling apparatus of claim 14 wherein said cam ring is longitudinally fixed to and freely rotatable relative to said collar.

16. The coupling apparatus of claim 15 further including a raised portion adjacent to said at least one radial pin, wherein said flanges include radially inwardly facing friction surfaces adapted to frictionally engage upon said raised portion.

17. The coupling apparatus of claim 16 wherein said raised portion is located longitudinally on said insert distal to the free end of said second shaft when said insert is secured to said second shaft.

18. The coupling apparatus of claim 17 wherein said raised portion and said at least one radial pin have leading edges being the edges that are first engaged by said friction surfaces and said flanges, respectively, as said cam ring is rotated into said first position, said leading edge of said friction surface being axially staggered relative to said leading edge of said at least one pin such that said leading edge of said friction surface is engaged before said leading edge of said pin when said cam ring is rotated into said first position.

19. A twin-bladed paddle assembly comprising:

first and second paddle segments each having a handle portion for mounting a paddle blade at an outboard end, the handle portions defining a feathering axis about which said paddle segments may independently rotate;

said first handle portion having at least one radial pin;

said second handle portion having at least one axial notch, said axial notches accepting and engaging said at least one radial pin along an engagement plane; and a camming device adapted to retain said at least one radial pin in engagement with said at least one radial notch to rotationally fix the relative angular position of said paddle segments, wherein said camming device comprises a cam ring circumscribing said engagement plane and adapted for rotation about said feathering axis and locatable at first and second positions relative to said at least one radial pin, said cam ring having at least one cam surface to retain said at least one radial pin in engagement with said at least one axial notch upon rotation to said first position, and configured to permit axial displacement of said at least one radial pin to disengage from said at least one axial notch upon rotation to said second position.

20. The twin-bladed paddle assembly of claim 19 wherein said at least one radial pin comprises 4 radial pins.

21. The twin-bladed paddle assembly of claim 19 wherein said at least one axial notch comprises a multiple of the number of said at least one radial pin.

22. The twin-bladed paddle assembly of claim 19 wherein said at least one radial pin and said at least one axial notch have complementary shapes.

23. The twin-bladed paddle assembly of claim 22 wherein said at least one radial pin and said at least one axial notch have substantially V-shapes.

24. The twin-bladed paddle assembly of claim 19 wherein said engagement plane is normal to said feathering axis.

25. The twin-bladed paddle assembly of claim 19 wherein said at least one radial pin has at least one substantially radial sidewall surface for engaging said camming device.

26. The twin-bladed paddle assembly of claim 19 wherein said camming surfaces are defined by a plurality of flanges projecting inwardly toward said feathering axis, said flanges having first and second ends and defining radial slots between said first end and a second end of an adjacent flange for permitting said at least one radial pin to pass for detachment and repositioning of the paddle segments.

* * * * *